US007131224B1

(12) United States Patent
Elliott et al.

(10) Patent No.: US 7,131,224 B1
(45) Date of Patent: Nov. 7, 2006

(54) STORAGE BIN WITH ATTACHABLE LABEL HOLDER

(75) Inventors: Ronald C. Elliott, Monterey, CA (US); Renee D. Farrington, Salinas, CA (US)

(73) Assignee: Excelligence Learning Corporation, Monterey, CA (US)

( * ) Notice: Subject to any disclaimer, the term of this patent is extended or adjusted under 35 U.S.C. 154(b) by 0 days.

(21) Appl. No.: 10/631,992

(22) Filed: Jul. 30, 2003

(51) Int. Cl.
*G09F 3/00* (2006.01)

(52) U.S. Cl. ..... 40/312; 40/642.02

(58) Field of Classification Search ..... 40/299.01, 40/306, 324, 488, 506, 649, 651, 312, 666, 40/642.02; 206/508, 509, 372, 373, 459.1, 206/459.5; 220/4.32, 521, 523, 532; 312/183, 312/185

See application file for complete search history.

(56) References Cited

U.S. PATENT DOCUMENTS

| | | | | |
|---|---|---|---|---|
| 1,761,995 | A * | 6/1930 | Siebe | 40/651 |
| 2,665,808 | A * | 1/1954 | McAlister | 312/183 |
| 2,908,985 | A * | 10/1959 | Hartman | 40/324 |
| 3,321,855 | A * | 5/1967 | Phelps | 40/651 |
| 3,650,055 | A * | 3/1972 | Bult, III | 40/506 |
| 4,373,642 | A * | 2/1983 | Wolters et al. | 206/509 |
| 4,405,057 | A * | 9/1983 | Stein | 206/508 |
| 4,863,026 | A * | 9/1989 | Perkowski | 206/459.5 |
| 5,135,110 | A * | 8/1992 | Morita | 206/459.5 |
| 5,285,900 | A * | 2/1994 | Swingler | 206/508 |
| 5,508,006 | A * | 4/1996 | Gabele et al. | 206/459.5 |
| 5,738,241 | A * | 4/1998 | McEntee | 220/532 |
| 5,893,453 | A * | 4/1999 | Ishikawa | 206/459.5 |
| 5,992,073 | A * | 11/1999 | Wolpa | 40/651 |
| 6,658,771 | B1 * | 12/2003 | Forrest et al. | 40/312 |
| 6,959,507 | B1 * | 11/2005 | Bazany et al. | 40/312 |

FOREIGN PATENT DOCUMENTS

GB 2242180 A * 9/1991

OTHER PUBLICATIONS

"Shelf Bins & Systems", Quantum Storage Systems, http://www.quantumstorage.com/6a.htm, pp. 1 of 3.
"Lakeshore Labeling Pockets—TT151", Lakeshore Labeling Pockets, http://www.lakeshorelearning.com/IWCatProductPage.process?Merchant_Id=1&Catalog_=1&Product_.., pp. 1 of 1.

* cited by examiner

*Primary Examiner*—Lars A. Olson
(74) *Attorney, Agent, or Firm*—Haverstock & Owens LLP

(57) ABSTRACT

A plastic storage bin comprising a container and a label holder is disclosed. The label holder is configured to rotatably and detachably couple with the container. The label holder preferably comprises a clear rigid plastic designed to hold a 3"×5" card that describes the contents of the container. Specifically, the preferred label holder is configured to rotatably and detachably couple with a label holder securing means by cooperatively engaging a plurality of protrusions with a plurality of apertures. The storage bin further comprises a lid configured to mate with the container so as to create a positive seal. The plastic storage bin with a rotatably attachable label holder is easily assembled and disassembled without the use of any tools, glue, tape or other adhesives.

44 Claims, 4 Drawing Sheets

STORAGE BIN WITH ATTACHABLE LABEL HOLDER

FIELD OF THE INVENTION

The present invention relates to the field of plastic storage bins. More particularly, this invention relates to storage bins that have an attachable label holder.

BACKGROUND OF THE INVENTION

Plastic storage bins have been well known for many years. Plastic storage bins have a variety of commercial and home uses, such as their use as containers of supplies, clothing, tools, toys, and the like.

Current plastic storage bins do not have removable label holders. Therefore, the user of a bin does not have an easy means to identify the contents of the bin, unless the bin is transparent, the user is looking directly into the bin itself, or the user has affixed a label to the bin that describes the bin's contents. Because bins are often located on shelving, or in such other manner that prevents the user from looking directly into the bin, the user is unable to easily determine the bin's contents. Affixing a label to the bins by means of tape, glue or other adhesive material is cumbersome and requires the often-messy or time consuming effort to remove the affixed label when the contents of the bin are changed. Furthermore, tape, glue or some other adhesive material on a label is necessary in order to fully label the contents of the bin.

It is difficult to ascertain the contents of current plastic storage bins without looking directly into the bins. It is also difficult to label these prior plastic storage bins without using a separate adhesive, such as tape, glue or other adhesive label.

SUMMARY OF THE INVENTION

A storage bin with an attachable label holder is currently disclosed. Specifically, a storage bin preferably comprises a container (or similar chamber configured for storing) and a label holder configured to rotatably and detachably couple with the container. The label holder is designed to rotatably attach with the container and hold a card that describes the contents of the container. When assembled together, the container and the plastic label holder form a storage bin with a rotatably attachable label holder.

The storage bin is preferably uniformly formed from a homogenous plastic material. The homogenous material may comprise, but is not limited to, polymer resin, polypropylene, or liquid impervious plastic materials.

The storage bin may further comprise a lid configured to mate with the container so as to create a positive seal. In alternate embodiments, the lid further comprises a tab configured to facilitate removal of the lid from the apparatus. In alternate embodiments, the lid couples to the container through a locking structure that frictionally engages so as to create a positive seal. In yet other embodiments, the lid is configured to cooperatively engage with the container. In addition to the lid, the preferred storage bin further comprises one or more handles coupled to the container.

The container is preferably substantially rectangular and may be of any size. In alternate embodiments, the container is generally parallelepiped-shaped. The container comprises a hollow body (or any similar chamber configured for storing). Specifically, the container comprises an integrally formed inside and outside. The inside comprises the hollow body (or a similar chamber) configured for storing. The container also has a front end and a rear end. Preferably, the front end of the container further comprises a first securing structure (or in alternate embodiments, other means, such as a label securing means) configured to allow the label holder to detachably and rotatably couple with the container.

The preferred label holder is clear and is uniformly formed from a rigid plastic. Further, the preferred label holder is configured to hold and allow insertion and removal of a label. The label to be held is preferably a 3"×5" card. Specifically, the 3"×5" label is inserted into the clear label holder from an open top and is held in place and enclosed by the two sides and bottom. But, in alternate embodiments, the label holder may be configured to hold labels in various sizes. Further, in alternate embodiments, a label could be slightly bent and inserted into the label holder. In yet other embodiments, the label holder is configured to hold and allow insertion and removal of a label horizontally (via open sides, for example).

The means for detachably and rotatably coupling the label holder with the container may vary. For example, in the preferred embodiment of the current invention, the label holder comprises a plurality of protrusions, while the container comprises a plurality of apertures. Thus, the label holder is configured to rotatably and detachably couple with the label holder securing means by cooperatively engaging the plurality of protrusions with the plurality of apertures.

In another embodiment, the container would comprise a first securing structure and the label holder would comprise a second securing structure. The first and second securing structures are configured to mate and detachably secure the label holder with the container. In an alternate embodiment, the label holder is configured to slideably engage with the container. Further, in alternate embodiments, the apparatus comprises one or more guiding means configured to detachably couple with the outer walls of the container.

DETAILED DESCRIPTION OF THE INVENTION

The present invention is a plastic storage bin with a rotatably attachable label holder that preferably allows a user to conveniently attach a 3"×5" card listing the contents of the bin or information regarding the contents of the bin. The label holder is attachable to the plastic storage bin without utilizing any tools, or any glue, tape or other adhesives. While assembled, the plastic storage bin with the rotatably attachable label provides the user with an easy means to identify the contents of the bin without having to look directly into the bin or having to attach labels through the use of glue, tape, or other adhesives. Further, the label holder can be detached from the plastic storage without the use of tools or having to remove glue, tape, or other adhesives.

Specifically, the preferred storage bin comprises a container and a label holder. The label holder is configured to rotatably and detachably couple with the container. The storage bin further comprises a lid configured to mate with the container so as to create a positive seal. The label holder is designed to hold a card that describes or includes information about the contents of the container. When assembled together, the container and the plastic label holder form the storage bin with a rotatably attachable label holder. The storage bin is uniformly formed from a homogenous material, preferably plastic. However, the homogenous material may comprise, but is not limited to, polymer resin, polypropylene, or liquid impervious plastic materials.

Figure 1:
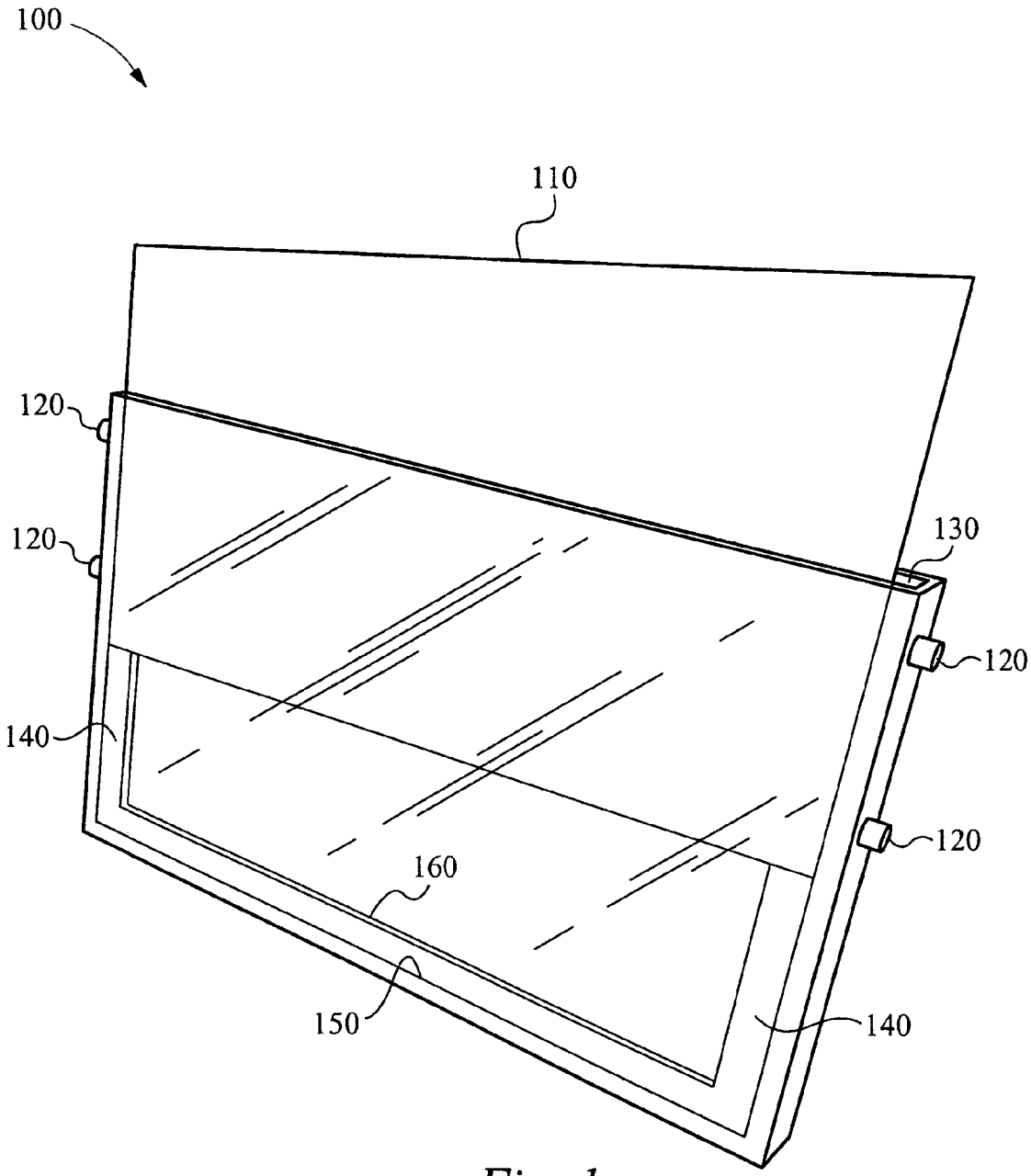
FIG. 1 illustrates a perspective view of the preferred embodiment of an unattached plastic label holder, with a 3"×5" label card partially inserted into the label holder.

FIG. 1 illustrates the preferred label holder 100. The label holder 100 is clear and is uniformly formed from a rigid plastic. Alternately, the label holder 100 is opaque in the portions other than through which the label is viewable, such as the sides and the back of the label holder. In alternate embodiments, the label holder 100 is formed from another rigid or semi-rigid material. Further, the preferred label holder is configured to hold and allow insertion and removal of a label 110. In addition, the preferred label holder comprises a plurality of protrusions 120 (or other similar securing structure). The label 110 to be held by the label holder 100 is preferably a 3"×5" card. Specifically, the label 110 is inserted into the clear label holder 100 from an open top 130 and is held in place by the enclosed sides 140 and the bottom 150. Specifically, the preferred label holder 100 is approximately 3⅛"×5¼". The plurality of protrusions 120 of the label holder 100 are preferably located on each 3⅛" side of the label holder 100. In addition, the rear side (not shown) of the label holder 100 has an inward-facing lip 160 that extends ⅛ inch toward the center from sides 140 and the bottom 150 of the label holder 100. A 3"×5" label is insertable into the top side 130 of the label holder 100, and is held in place by the inward facing lip 160 extending from the other sides and bottom of the label holder 100. In alternate embodiments, the label holder 100 is configured to hold labels ranging in various sizes. Further, in other embodiments, the label holder 100 is configured to hold and allow insertion and removal of a label horizontally (via open sides, for example).

Figure 2A:
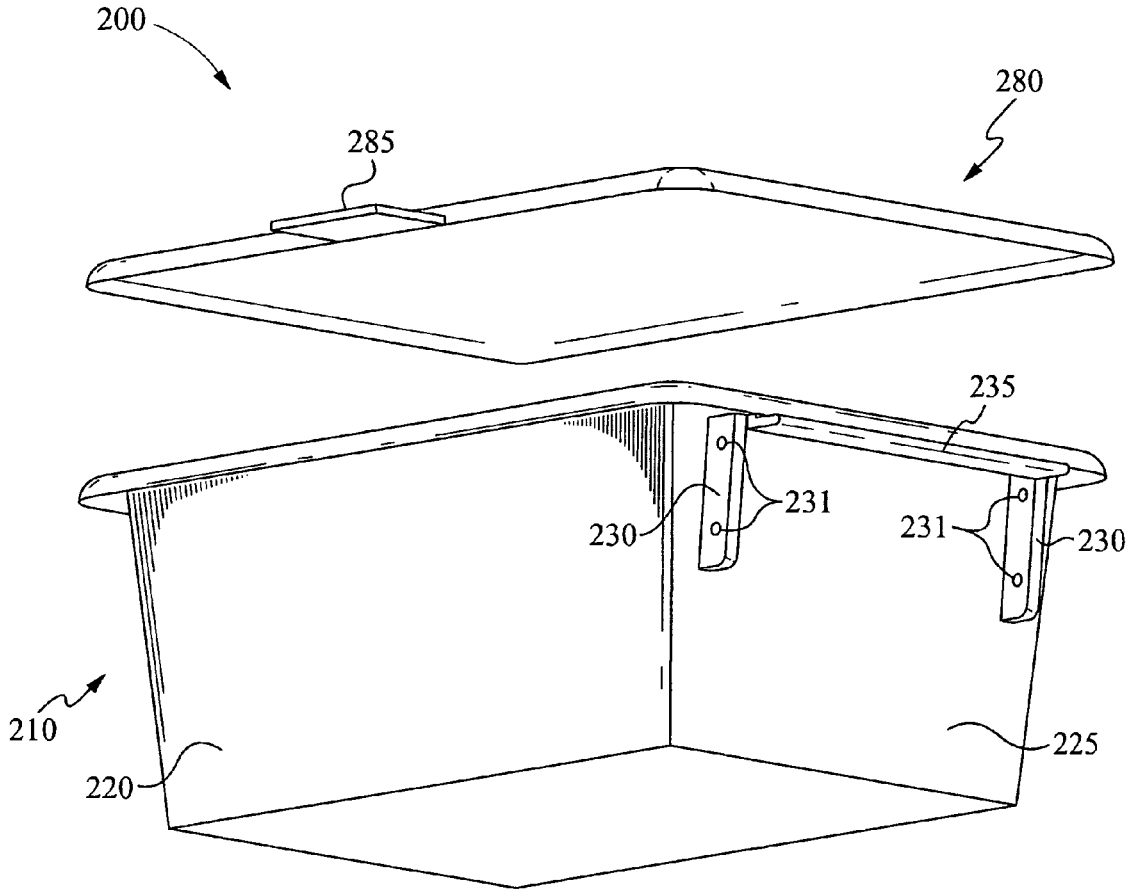
FIGS. 2A–2B illustrate perspective views of a plastic storage bin, with the plastic label holder (shown in FIG. 1) detached.
Figure 2B:
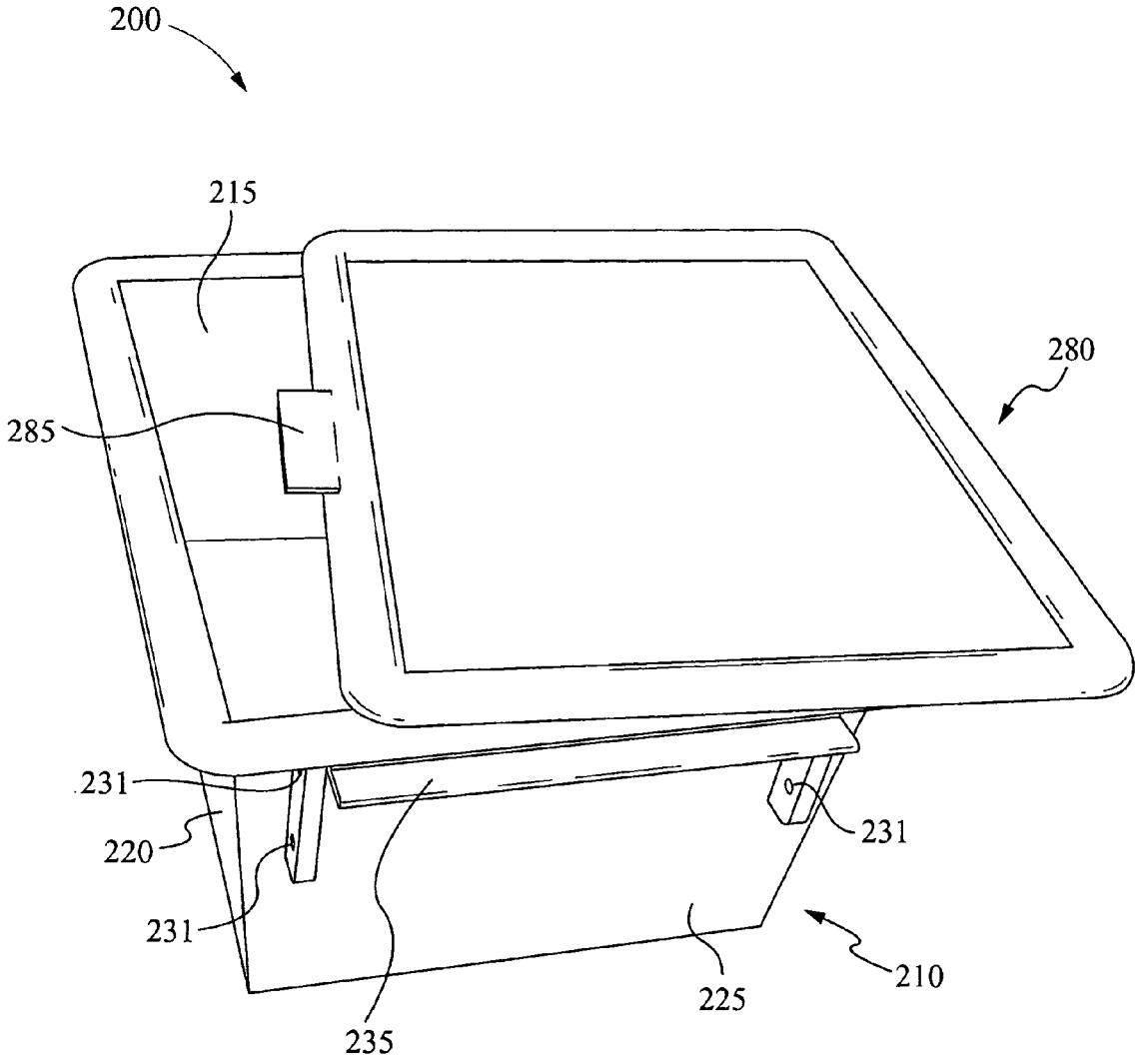

FIGS. 2A–2B illustrate a storage bin 200 with the label holder 100 (described above) detached. Specifically, the storage bin 200 comprises a container 210 and a lid 280. The container 210 is preferably substantially rectangular and may be of any size. In alternate embodiments, the container 210 is generally parallelepiped-shaped. The container 210 comprises a hollow body 215, as shown in FIG. 2B. Specifically, the container comprises an integrally formed inside (not shown) and outside 220. The inside comprises the hollow body 215 (or a similar main chamber) configured for storing. The container 210 also has a front end 225 and a rear end (not shown). Preferably, the front end 225 of the container 210 further comprises a first securing structure 230 (or similar label holder securing means) configured to allow the label holder 100 to couple with the container 210. In addition, the preferred container 210 further comprises one or more handles 235 coupled to the container.

The first securing structure 230 preferably further comprises a plurality of apertures 231. The first securing structure 230 is preferably centered on the front end 225 of the container 210. Further, the first securing structure 230 preferably measures approximately 2⅛" down from the top of the container 210 and set ½" away from the sides of the container 210. The plurality of apertures 231 of the first securing structure preferably comprise two paired holes (as shown in FIGS. 2A–2B), with the two top holes located ½" from the top edge of the first securing structure 230 and the two bottom holes are located ⅜" from the bottom edge of the first securing structure 230. The distance between the top holes is approximately 5⅜".

FIGS. 2A and 2B also illustrate a lid 280 configured to mate with the container 210 so as to create a positive seal. In alternate embodiments, the lid 280 further comprises a tab 285 configured to facilitate removal of the lid 280 from the container 210. In alternate embodiments, the lid 280 couples to the container 210 through a locking structure (not shown) that frictionally engages so as to create a positive seal. In yet another embodiment, the lid 280 is configured to cooperatively engage with the container 210.

Figure 3A:
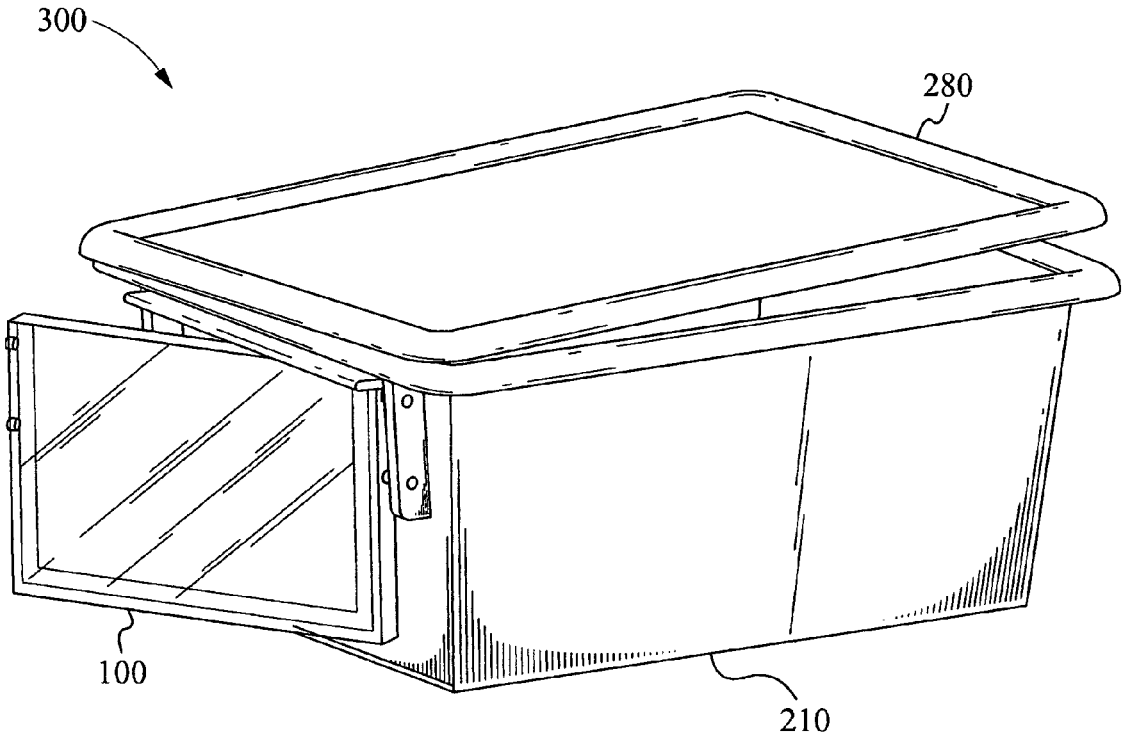
FIGS. 3A–3B illustrate perspective views of the plastic storage bin (shown in FIGS. 2A–2B) with the label holder (shown in FIG. 1) rotatably attached.
Figure 3B:
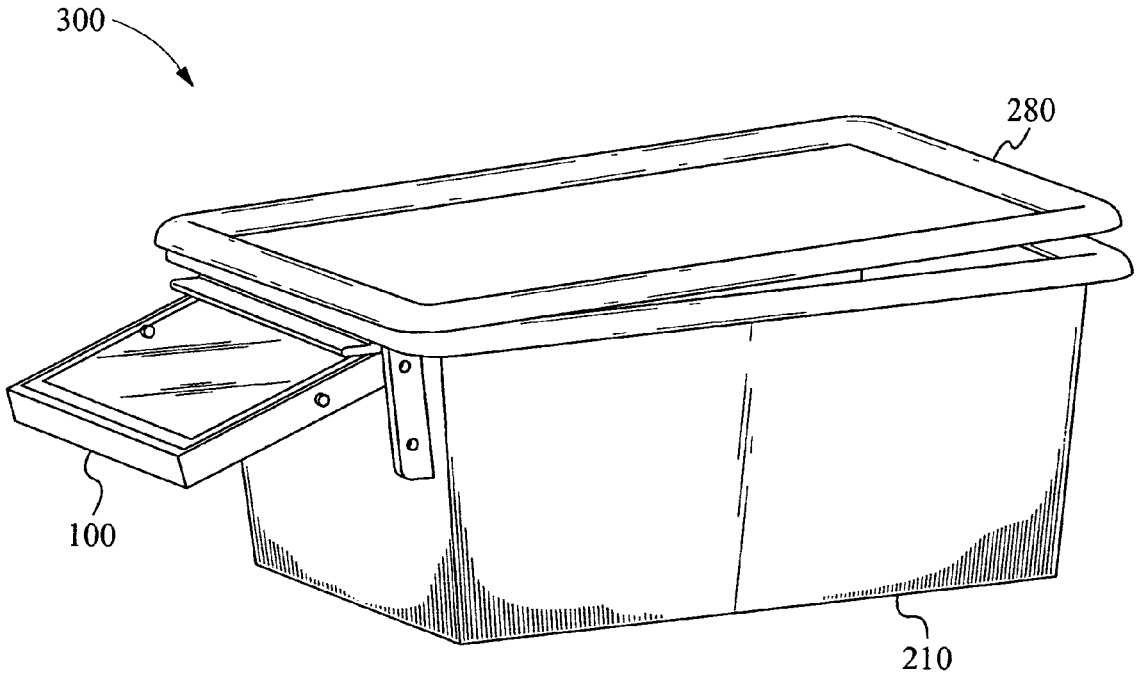

FIGS. 3A and 3B illustrate a plastic storage bin 300 with the label holder 100 detachably and rotatably coupled to the container 210, and the lid 280. The means for detachably and rotatably coupling the label holder 100 with the container 210 may vary. For example, in the preferred embodiment of the current invention, the plurality of protrusions 120 of the label holder 100 and the plurality of apertures 231 of the first securing structure 230 of the container 210 are configured to rotatably and detachably couple. In other words, the plurality of protrusions 120 cooperatively engage with the plurality of apertures 231.

In another embodiment, the container comprises a first securing structure and the label holder comprises a second securing structure. The first and second securing structures are configured to mate and detachably secure the label holder with the container. In an alternate embodiment, the label holder is configured to slideably engage with the container. Further, in alternate embodiments, the apparatus comprises one or more guiding means configured to detachably couple with the outer walls of the container.

When fully assembled together, the plastic storage bin with attachable label holder provides the user with an easy means to identify the contents of the bin without having to look directly into the bin or having to attach labels through the use of glue, tape or other adhesives. Attaching and detaching the label holder from the plastic storage bin is a convenient, simple process that is accomplished without any tools.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

Specifically, it will be apparent to one of ordinary skill in the art that the device of the present invention could be implemented in several different ways and the embodiments disclosed above are only exemplary of the preferred embodiment and the alternate embodiments of the invention and is in no way a limitation. In particular, the rectangular plastic storage bin can be substituted by a square storage bin, or any appropriate shape. The clear plastic label holder can be substituted by glass or other transparent material allowing visibility though the label holder to view the 3"×5" card inserted into the label holder. The 3"×5" card label holder can be substituted by other sized label holders.

What is claimed is:

1. A storage bin comprising:

a. a container including one or more apertures; and b. a label holder configured to rotatably and detachably couple with the container, wherein the label holder comprises one or more protrusions configured to cooperatively engage with the one or more apertures, and further wherein the label holder is configured to hold a label while rotating.

2. The storage bin of claim 1, wherein the storage bin further comprises a lid configured to mate with the container so as to create a positive seal.

3. The storage bin of claim 2, wherein the lid further comprises a tab configured to facilitate removal of the lid from the container.

4. The storage bin of claim 1, wherein the container is substantially rectangular.

5. The storage bin of claim 1, wherein the storage bin is uniformly formed from a homogenous material.

6. The storage bin of claim 1, wherein the label holder is further configured to hold and allow insertion and removal of a label.

7. The storage bin of claim 6, wherein the label ranges in size from 3"×5" to 8.5"×11".

8. The storage bin of claim 6, wherein the label ranges in size up to 8.5"×11".

9. A storage bin comprising:

a. a chamber configured for storing;

b. a rotatably attachable label holder including one or more protrusions, wherein the label holder is configured to hold a label while rotating; and c. a label securing structure coupled to the chamber and configured to detachably couple the rotatably attachable label holder to the chamber, wherein the securing structure comprises one or more apertures configured to cooperatively receive the one or more protrusions.

10. The storage bin of claim 9, wherein the storage bin further comprises a lid configured to detachably couple with the chamber.

11. The storage bin of claim 9, wherein the chamber further comprises one or more handles coupled to the chamber.

12. The storage bin of claim 9, wherein the storage bin is uniformly formed from a homogenous material.

13. The storage bin of claim 9, wherein the label holder is clear.

14. The storage bin of claim 9, wherein the label holder is configured to hold a 3"×5" card.

15. The storage bin of claim 9, wherein the label holder is uniformly formed from a rigid plastic.

16. A plastic storage bin comprising:

a. hollow body with a front end and a rear end, wherein the hollow body further comprises a first securing structure on the front end, wherein the first securing structure includes one or more apertures; and b. a label holder comprising a second securing structure, wherein the second securing structure includes one or more protrusions and further wherein the first securing structure rotatably and detachably mates with the second securing structure to secure the label holder with the hollow body, wherein the label holder is configured to hold a label while rotating.

17. The plastic storage bin of claim 16, wherein the hollow body is generally parallelepiped-shaped.

18. The plastic storage bin of claim 16, wherein the label holder is configured to allow a 3"×5" card to be inserted and removed therefrom.

19. A labeled storage apparatus comprising:

a. a container comprising integrally formed inner walls and outer walls and one or more apertures coupled to the outer walls;

b. one or more label holders each comprising one or more protrusions configured to rotatably and detachably engage with the one or more apertures and configured to hold a label while rotating; and c. a lid configured to detachably couple with the container.

20. The labeled storage apparatus of claim 19, wherein the label comprises a 3"×5" card.

21. The labeled storage apparatus of claim 19, wherein the label comprises paper with a size in the range of 3"×5" to 8.5"×11".

22. The labeled storage apparatus of claim 19, wherein the label ranges in size up to 8.5"×11".

23. The labeled storage apparatus of claim 19, wherein the container is in a substantially rectangular shape.

24. The labeled storage apparatus of claim 19, wherein the lid couples to the container through a locking structure that frictionally engages so as to create a positive seal.

25. The labeled storage apparatus of claim 19, wherein the apparatus further comprises one or more guiding means configured to detachably couple with the outer walls.

26. The labeled storage apparatus of claim 19, wherein the apparatus is uniformly formed from a homogenous material.

27. The labeled storage apparatus of claim 26, wherein the homogenous material comprises a polymer resin.

28. The labeled storage apparatus of claim 26, wherein the homogenous material comprises polypropylene.

29. The labeled storage apparatus of claim 26, wherein the homogenous material comprises a liquid impervious plastic material.

30. The labeled storage apparatus of claim 19, wherein the lid further comprises a tab configured to facilitate removal of the lid from the apparatus.

31. A storage bin comprising:

a. a container means comprising an inside and an outside, wherein the inside comprises a main chamber configured for storing;

b. a lid configured to cooperatively engage with the container means;

c. a label holder securing means comprising a plurality of apertures, wherein the label holder securing means is coupled to the outside of the container; and d. a label holder configured for holding a label and comprising a plurality of protrusions, wherein the label holder is configured to rotatably and detachably couple with the label holder securing means by cooperatively engaging the plurality of protrusions with the plurality of apertures, and further wherein the label holder is configured to hold a label while rotating.

32. The storage bin of claim 31, wherein the label comprises paper with a size in the range of 3"×5" to 8.5"×11".

33. The storage bin of claim 31, wherein the label ranges in size up to 8.5"×11".

34. The storage bin of claim 31, wherein the lid and the container means further comprise a locking structure configured to frictionally engage so as to create a positive seal.

35. A label holder configured to hold and allow insertion and removal of a label, wherein the label holder comprises one or more securing structures configured to mate and rotatably and detachably secure the label holder with a container, and wherein the one or more securing structures comprise a plurality of protrusions configured to cooperatively engage with a plurality of apertures, and further wherein the label holder is configured to hold a label while rotating, wherein the label holder further comprises:

a. an open top;

b. a left side;

c. a right side;

d. a bottom side;

e. a front side; and f. a rear side, wherein the rear side comprises an inward-facing lip configured to partially extend toward the center of the label holder from the right, left, and bottom sides.

36. The label holder of claim 35, wherein the label holder is clear and is uniformly formed from a rigid plastic.

37. The label holder of claim 35, wherein the label holder is uniformly formed from a semi-rigid material.

38. The label holder of claim 35, wherein the label is a 3"×5" card.

39. The label holder of claim 35, wherein the label is a paper with a size in the range of 3"×5" to 8.5"×11".

40. The label holder of claim 35, wherein the label ranges in size up to 8.5"×11".

41. A labeled storage apparatus comprising:

a. a container comprising integrally formed inner walls and outer walls and one or more apertures;

b. one or more label holders rotatably and detachably coupled to the outer walls and configured to hold a label while rotating, wherein the label holders comprise one or more protrusions configured to cooperatively engage with the one or more apertures; and c. a lid configured to detachably couple with the container, wherein the lid further comprises a tab configured to facilitate removal of the lid from the apparatus.

42. A storage bin comprising:

a. a container including one or more apertures; and b. a label holder configured to rotatably and detachably couple with the container, and configured to independently hold and allow insertion and removal of a label, wherein the label holder comprises one or more protrusions configured to cooperatively engage with the one or more apertures and further wherein the label holder is configured to hold the label while rotating.

43. A labeled storage apparatus comprising:

a. a container comprising integrally formed inner walls and outer walls and one or more apertures coupled to the outer walls;

b. one or more label holders each configured to independently hold a label therewithin while rotating, and each comprising one or more protrusions configured to rotatably and detachably engage with the one or more apertures; and c. a lid configured to detachably couple with the container.

44. A storage bin comprising:

a. a container means comprising an inside and an outside, wherein the inside comprises a main chamber configured for storing;

b. a lid configured to cooperatively engage with the container means;

c. a label holder securing means comprising a plurality of apertures, wherein the label holder securing means is coupled to the outside of the container; and d. a label holder comprising a plurality of protrusions, wherein the label holder is configured to rotatably and detachably couple with the label holder securing means by cooperatively engaging the plurality of protrusions with the plurality of apertures, and further wherein the label holder is configured to hold a label while rotating.

* * * * *